US007997448B1

(12) United States Patent
Leyva

(10) Patent No.: US 7,997,448 B1
(45) Date of Patent: Aug. 16, 2011

(54) UNIVERSAL BEVERAGE DISPENSER

(76) Inventor: Robert Leyva, Roswell, NM (US)

( * ) Notice: Subject to any disclaimer, the term of this patent is extended or adjusted under 35 U.S.C. 154(b) by 364 days.

(21) Appl. No.: 11/670,352

(22) Filed: Feb. 1, 2007

(51) Int. Cl.
*B67D 1/10* (2006.01)

(52) U.S. Cl. ..... 222/129.1; 222/333; 222/1

(58) Field of Classification Search ..... 222/1, 129, 222/129.1, 63, 333, 255, 263, 266, 278, 23
See application file for complete search history.

(56) References Cited

U.S. PATENT DOCUMENTS

| | | | | |
|---|---|---|---|---|
| 4,356,937 | A | 11/1982 | Simon et al. | |
| 4,520,950 | A | 6/1985 | Jeans | |
| 4,679,707 | A | 7/1987 | Sedam | |
| 4,688,701 | A | 8/1987 | Sedam | |
| 4,728,005 | A * | 3/1988 | Jacobs et al. | 222/64 |
| 4,928,854 | A * | 5/1990 | McCann et al. | 222/129.1 |
| 5,312,233 | A * | 5/1994 | Tanny et al. | 417/316 |
| 5,415,326 | A * | 5/1995 | Durham et al. | 222/129.1 |
| 5,542,265 | A | 8/1996 | Rutland | |
| 5,769,271 | A * | 6/1998 | Miller | 222/1 |
| 5,797,519 | A * | 8/1998 | Schroeder et al. | 222/129.1 |
| 5,813,246 | A | 9/1998 | Oh | |
| 5,956,967 | A | 9/1999 | Kim | |
| 5,992,685 | A * | 11/1999 | Credle, Jr. | 222/1 |
| 6,039,219 | A | 3/2000 | Bach et al. | |
| 6,059,145 | A | 5/2000 | Stratton et al. | |
| 6,170,707 | B1 * | 1/2001 | Wolski et al. | 222/129.1 |
| 6,337,015 | B1 | 1/2002 | Poirier | |
| 6,669,053 | B1 | 12/2003 | Garson et al. | |
| 6,751,525 | B1 | 6/2004 | Crisp, III | |
| 6,756,069 | B2 | 6/2004 | Scoville et al. | |
| 6,761,036 | B2 | 7/2004 | Teague et al. | |
| 6,766,656 | B1 | 7/2004 | Crisp, III et al. | |
| 6,827,113 | B2 | 12/2004 | Downs et al. | |
| 6,848,600 | B1 | 2/2005 | Crisp, III | |
| 6,857,541 | B1 | 2/2005 | Crisp, III | |
| 6,871,761 | B2 * | 3/2005 | Fox | 222/129.1 |
| 6,896,159 | B2 | 5/2005 | Crisp, III et al. | |
| 6,915,925 | B2 | 7/2005 | Crisp, III et al. | |
| 7,070,068 | B2 * | 7/2006 | Fox | 222/129.1 |
| 7,203,572 | B2 * | 4/2007 | Crisp, III | 700/239 |
| 7,559,346 | B2 * | 7/2009 | Herrick et al. | 141/105 |
| 2003/0085237 | A1 * | 5/2003 | Kateman et al. | 222/1 |
| 2004/0217124 | A1 * | 11/2004 | Crisp, III | 222/25 |
| 2005/0112249 | A1 * | 5/2005 | Herrick et al. | 426/249 |
| 2005/0133420 | A1 * | 6/2005 | Rinker et al. | 210/143 |
| 2005/0194399 | A1 * | 9/2005 | Proctor | 222/1 |
| 2005/0284885 | A1 | 12/2005 | Kadyk et al. | |
| 2007/0215239 | A1 * | 9/2007 | Dorney | 141/94 |

* cited by examiner

*Primary Examiner* — Kevin P Shaver
*Assistant Examiner* — Donnell Long
(74) *Attorney, Agent, or Firm* — Janeeen Vilven; Justin R. Jackson; Peacock Myers, P.C.

(57) ABSTRACT

A multiple beverage dispensing method and apparatus for selectively dispensing a beverage which is stored in a concentrated form and optionally for dispensing water without a concentrate added thereto.

25 Claims, 9 Drawing Sheets

UNIVERSAL BEVERAGE DISPENSER

BACKGROUND OF THE INVENTION

1. Field of the Invention (Technical Field)

An embodiment of the present invention relates to a method and apparatus for dispensing a plurality of beverages. Particularly, an embodiment of the present invention relates to method and apparatus for dispensing beverages which are stored in a concentrated form.

2. Description of Related Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

Each year 656,557,800,000 beverages are packaged and sold globally. Approximately 54.1% are carbonated soft drinks, 25.6% are bottled water, 14.6% are fruit beverages, and 5.7% are ready-to-drink tea and/or coffee. (*Beverage World* September 2004, Pg. 20). According to the Container Recycling Institute, in America alone, over one trillion aluminum beverage cans have been trashed from 1972-2003. In today's market this would be worth over 21 billion dollars. The cost of manufacturing such drinks include thousands of square miles of habitat loss on every major continent, the displacement of tens of thousands of indigenous people, and the release of tons of greenhouse gasses and other toxic air and water pollutants. For these environmental reasons alone, many states have instituted a redemption charge on a variety of beverage containers. Fees vary by state and package; for example, in California, 4 cents per 12 oz can or 96 cents per case of 24-12 oz containers is assessed in hope of increasing the recycling rate. This tactic works in varying degrees. The cost is completely absorbed by the consumer at a cost of millions of dollars yearly. Although such fees have been implemented, recycling rates have actually declined in the past few years. The solution: raise taxes or find another alternative.

Another inconvenience of present day containers in the beverage industry is the constant hassle of the commute back and forth to retail outlets to replenish the regularly depleted supply of heavy liquid-filled containers. Many times this happens at the most inopportune time (during parties, gatherings, telecast games, meals, holiday events, family functions, etc).

Today's beverages consume an unworldly amount of cubic space and money in all fronts, including shipping, warehousing, retail, and residential. Many retailers (mostly restaurants and convenience stores) and beverage producers realize this inefficiency and have moved towards correcting this situation by offering commercial post-mix beverages to their consumers, thus saving their commercial customers valuable retail space while increasing their profitability. While these current commercial post-mix dispensers offer a solution for commercial applications, they are far too bulky, complex, and expensive for residential use.

Ideally a residential post mix beverage dispenser should be capable of dispensing multiple beverages having different viscosities and dilution with either carbonated or non-carbonated water. In an attempt to dispense multiple beverages having different viscosities, apparatuses have employed costly pumps, which need to be adjusted when changing product types. Other beverage dispenser designs may attempt to avoid the potential of carbonating syrups by utilizing different gasses which can be inconvenient as people are required to stock and maintain a carbonation gas and a non-carbonation gas. Alternatively, specialized containers may be provided for different product types, each with a different nozzle for each individual need. Such costly, specially-adapted systems are undesirable for numerous obvious reasons. Finally, pressurized syrup canisters provide an explosion hazard where heat or puncture can potentially cause such a cylinder to explode thus resulting in personal injuries as well as damage property.

U.S. Pat. No. 6,915,925 discloses a residential beverage dispenser wherein syrup containers are individually pressurized and can thus self-expel syrups. The syrup and water (carbonated or noncarbonated) combine in a mixer for dispensing through a channel into a cup. The beverage dispenser is wholly located within a refrigerator door thereby limiting the selection of beverages that may be dispensed. The beverage dispenser fails to provide the ability to accurately monitor and control pressures in each canister individually in order to control the flow rates of the concentrate being dispensed. The beverage dispenser fails to control the flow rates for the different syrup viscosity beverages thus creating a potential to over or under carbonate the syrup in diet colas and other concentrates, thus producing undesirable results. Further, the beverage interfaces with the mixing channel where it will leave syrup residue within the mixing channel and encourage mold and bacteria growth thereby necessitating frequent cleanings to prevent bacterial growth. The design requires the canister be located near the dispensing nozzle.

U.S. Pat. No. 6,756,069 to Scoville et al. describes a two component concentrated beverage dispenser for a countertop wherein the two beverage components are pumped from separate compartments through one peristaltic pump and are combined in the mixing chamber. The flow rate from each compartment is uniform. The inability to control the flow rate for concentrates of different viscosity results in beverages that are not diluted properly in light of their particular viscosity.

U.S. Pat. No. 6,669,053 to Garson et al. discloses a vending machine beverage dispenser wherein beverage concentrate is connected to a manifold through a conduit having a valve that controls the flow of concentrate to the manifold when a vacuum pump is engaged. The valves are each controlled by a microprocessor that also controls the multiple pumps that control operation of each valve. The requirement for a separate pump to separately drive each vacuum pump is costly for home use.

U.S. Pat. No. 5,797,519 to Schroeder et al. discloses a tabletop postmix beverage dispenser wherein the concentrate is pumped via a peristaltic pump driven by a gearhead motor for each concentrate to be delivered. U.S. Pat. No. 5,797,519 requires a dedicated dispensing nozzle for each concentrate dispensed. The flow rate for each concentrate is determined by a ratio card which is inserted by a user into a slot in the door that informs the control system as to the ration to use for each concentrate package. The dispenser has limited capacity for beverage distribution since the concentrate is stored within the beverage dispenser.

Another issue with residential postmix beverage dispensers is that many children and adults are on restricted diets that require limited consumption of certain sugar drinks and or overall restriction of total calories in a day. A residential postmix dispenser that could monitor and track the consumption of dispensed beverages for each user would be useful for parents and dieters alike.

There is thus a present need for a method and apparatus which provide a post-mix dispenser smaller in size, less complex in operation, easier to clean and maintain, more affordable than commercial models, more suited for residential use, and also optionally containing some type of low beverage warning, as well as the ability to selectively assign unique user codes such that individual users can be identified and so that selected users can be assigned administrative privileges over other users. There is also a need for a method and apparatus which can use peristaltic pumps to reliably and predictably pump concentrates of various viscosities without risking the introduction of bacteria therein and without the requirement of providing separate motors for each pump.

BRIEF SUMMARY OF THE INVENTION

One embodiment of the present invention provides a beverage dispenser. The beverage dispenser includes a first concentrate supply source in fluid communication with a dispenser, a first peristaltic pump for moving a fluid in said first concentrate supply source to said dispenser, a second concentrate supply source in fluid communication with said dispenser, a second peristaltic pump for moving a fluid in said second concentrate supply source to said dispenser. A first motor activates said first peristaltic pump and said second peristaltic pump. One or more water supply lines are connected to said dispenser. A carbonation source is connected to said dispenser. A processing unit receives instructions from a user via a user interface. The processing unit activates the motor.

Another embodiment of the present invention provides a beverage dispenser having a plurality of peristaltic pumps powered independently from a single drive motor. A container of concentrate in fluid communication with a dispenser, and one or more water supply lines in fluid communication with said dispenser. The user interface of the present embodiment may include a user interface. The user interface may include a display. The dispenser has a means to distinguish one or more users based on a user code. The beverage dispenser can be configured to function differently as determined by the inputting of a unique user code into the user interface. Product information can be displayed on the display. The product information may include nutritional information for the product and updates from the manufacturer regarding recalls or new beverage ideas. A warning sensor for low quantities of a concentrate may also be displayed.

Another embodiment of the present invention provides a method for dispensing a beverage. The method includes the steps of assigning one or more user codes to one or more users into a processing unit. Dispensing rules are input for one or more users. One or more users requests a beverage to be dispensed. A beverage is dispensed to a user based on the inputted rules. The present embodiment may include assigning one or more administrative codes to one or more users. Displaying product information to a display in conjunction with the dispensing of a beverage. Entering product data into a processor by for example electronically scanning the data into the processor and for example the product data is encoded and provided with a concentrate.

One aspect of the present invention provides a beverage dispenser with multiple peristaltic pumps per motor.

Another aspect of the present invention provides a single dispenser that is in fluid communication with multiple concentrate containers.

Another aspect of the present invention provides for decreasing waste associated with empty drink containers.

Yet another aspect of the present invention provides a microprocessor that would control the flow rate of the concentrate pumped from a container by a peristaltic pump associated with the container.

Still another aspect of the present invention provides a method for monitoring user selection of beverages.

Yet another aspect of the present invention provides a method for providing mixed drinks to a user.

Yet another aspect of the present invention provides for assigning user access codes that are associated with privilege level for accessing beverages from the beverage dispenser as disclosed in one or more embodiments of the present invention.

A further aspect of the present invention provides for improved measurement of concentrate for syrup drinks.

Further a beverage dispenser that serves as a bartender wherein a mixed drink, either alcoholic or non-alcoholic, would be delivered to the user is desirable.

A further aspect of the present invention provides for automatically recording the type, amount, and frequency of consumption of a beverage for a user using the user's code entered into the microprocessor through a keypad.

A further aspect of the present invention provides for recording information in the microprocessor about the stocking of the beverage dispenser.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Although the present application discusses and illustrates numerous supply lines, those skilled in the art will readily recognize that the manifolds and/or connecting structures can be used to reduce the number of lines illustrated and described in the present application.

The terms "supply line" and/or "line" as used throughout the specification and claims is used for the sake of simplicity and is intended to include any and all apparatuses, structures, elements, materials, methods or combinations thereof capable of conveying one or more liquids from a first location to a second location. The terms "supply line" and/or "line" can thus include, but are not limited to flexible, non-flexible, and semi-flexible tubing, hoses, pipes, combinations thereof, and the like.

The term "processor" as used throughout the specification and claims is intended to include one or more microcontrollers, microprocessors, assemblies of electrical components capable of achieving substantially the same objective, and combinations thereof.

The terms "syrup" and "concentrate" are used interchangeably throughout the specification and claims and are intended to include any and all ready to drink fully diluted beverages and beverage-related products which can be mixed/consumed as is, mixed with another syrup or concentrate added to water and/or carbonated water and/or any combination thereof to produce a consumable beverage.

As used herein, a, an, or the, means one or more.

Figure 1:
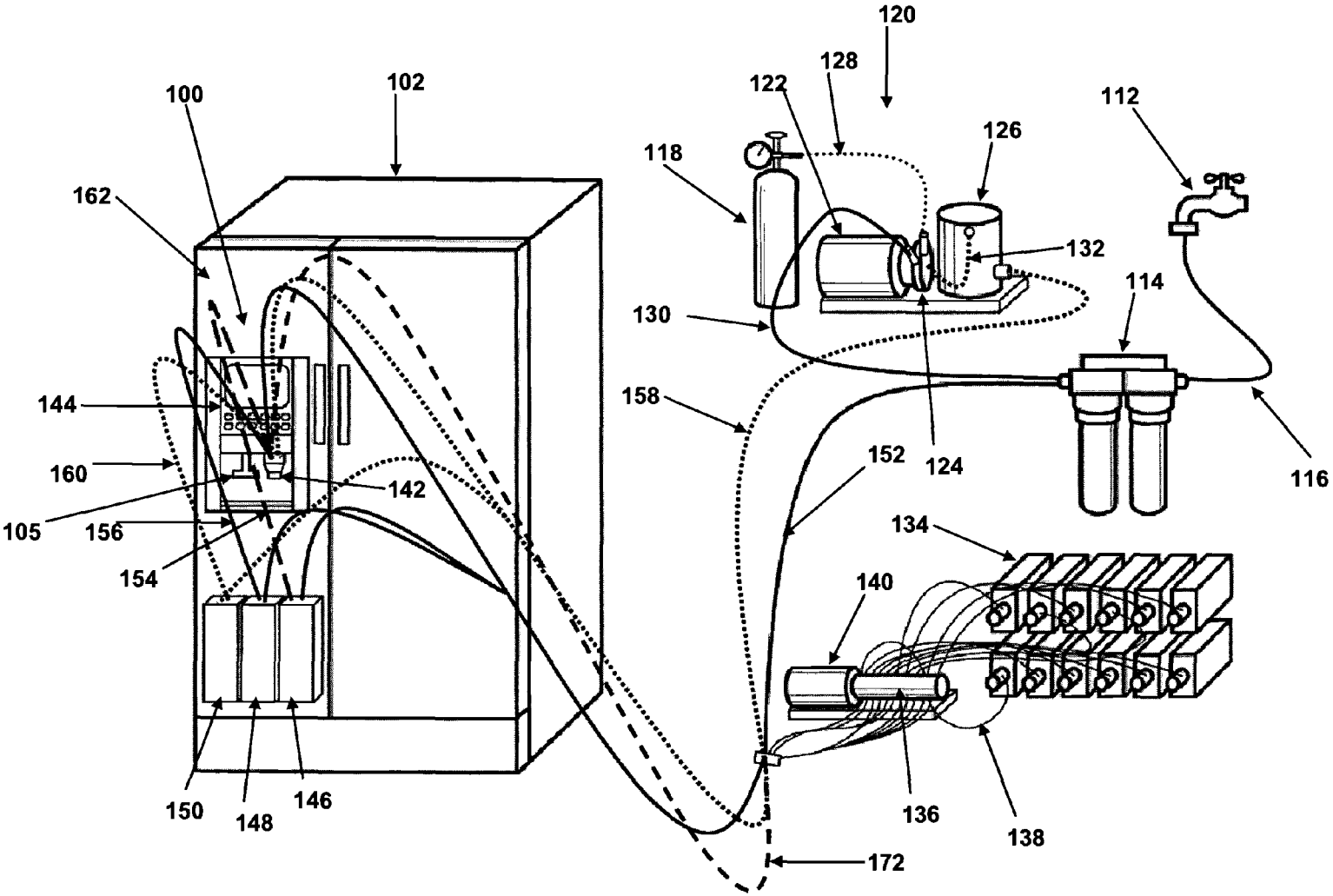
FIG. 1 is a drawing which schematically illustrates an embodiment of the present invention.

Referring now to the FIG. 1, an embodiment of a universal beverage dispenser is illustrated. The beverage dispenser 100 located within a door 144 of a refrigerator 102 is provided with water from water supply 112. Optionally, the water which supplies one embodiment of the present invention may come from any source suitable for human consumption. Many homes already have access to water whether it is by a public provider or a private or community well. In most cases, there is tubing readily available in homes for the sole purpose of supplying water to ice and water dispensers contained within residential refrigerators.

Water filtration system 114 is optionally used and may be one of any that are readily available at retail by many manufacturers for residential use. If water filtration system 114 is provided, it is preferably connected to water supply 112 via supply line 116. Water filtration system 114 preferably filters out any sediments or impurities which may alter the quality of the beverage or damage the equipment. Often, water filtration systems are provided for ice and water dispensers in refrigerators and water faucets and such existing filtration systems can optionally be used with one or more embodiments of the present invention.

Carbon Dioxide ($CO_2$) gas supply 118 may come from any source suitable to the beverage industry. Typically, commercial applications use a 20 lb cylinder (weighing around 40 lbs full) because it is able to carbonate over 1500 gallons of water in preparation of the post-mix process. While a 20 lb $CO_2$ cylinder can optionally be used and will provide desirable results, for residential applications of the present invention, a 5 lb cylinder (weighing around 12 lbs full) is preferably used. This is because of the reduced weight and size of the cylinder. A 5 lb cylinder at 3.7 volumes, which is Coca Cola's standard for carbonation, should yield over 375 gallons of carbonated water. The average U.S. person consumed approximately 53.5 gallons of carbonated soft drinks in 2004. Using this rate of consumption, a family of four would take up to a year and nine months to empty a 5 lb cylinder of $CO_2$.

Carbonation apparatus 120 is preferably used to carbonate the supply water. While carbonation apparatus 120 can be any of the known carbonation apparatuses including those typically used for commercial post-mix systems, carbonation apparatus 120 is preferably a smaller residential system containing small motor 122, agitator 124, and carbonation holding tank 126. This smaller system is preferable because it takes up less space and yet is sufficient for the carbonation demands of a normal household. As illustrated in FIG. 1, $CO_2$ from gas supply 118 is supplied to agitator 124 by $CO_2$ line 128. Water is supplied to agitator 124 from filtration system 114 (if used), via filtered water supply line 130. After being agitated from force provided by motor 122, the now carbonated water is then forced from carbonator 124 to carbonation holding tank 126 by a supply line 132. Upon studying this application, those skilled in the art will readily recognize that any other arrangement known to cause $CO_2$ to absorb into water can be used in place of the current illustration. This includes, but is not limited to the use of a holding tank with a hi-pressure supply of $CO_2$ which forces the water to naturally absorb the $CO_2$ over time. Further, if a pressure-forced absorption system is used, the tank is preferably disposed within the freezer or refrigerator door, thus exposing the water to a cold temperature and facilitating the water's absorption of $CO_2$. One drawback of the pressure-forced absorption system, however, is the inability to maintain carbonation during high usage situations such as gatherings or family functions and events. Another embodiment provides for the direct transfer of the agitated water to the cold water carbonated container 150 housed within the refrigerator thus eliminating the use of two tanks.

By using syrup supply containers 134, true savings in space, money, and waste is achieved. Because water to syrup ratios are typically about 4.5-1 to 5.5-1 for most post-mix carbonated soft drinks and up to 13-1 in some teas and lemonades, a user is provided the ability to save about 80% or more on packaging waste and space in all channels, from manufacture to consumption. This translates to reduced cost of production, shipping, warehousing, delivery, and retail space. Typically, these reductions results in savings that are passed down to the consumer in lower product cost and lesser redemption tax. Although virtually any size of syrup supply containers 134 can be used, including but not limited to those ranging in size from a few ounces to five gallons, a 1 to 2 liter cartridge housing a bag also known as a bag in the box is preferably used because of its ability to collapse as a vacuum is applied. If so desired, this smaller embodiment also allow for the concentrate to be stored within the refrigerator preferably in its own compartment similar to a meat and vegetable compartment in residential refrigerators. This configuration also allows for the storage of perishable concentrates requiring cold storage such as milk and juices. If the present invention is to be used in a residential environment, the connection from the box to the pump is preferably smaller than that typically used in current commercial applications. This is done in part to reduce waste. In order to also connect readily available bag in the box containers, an adaptor can optionally be provided.

Syrup is preferably supplied from supply containers 134 to supply pumps 136 through a series of syrup supply tubing 138. Supply pumps 136 can be a plurality of peristaltic pumps which are optionally powered by motor 140 which is common to all of pumps 136. A clutch device or other engagement mechanism is preferably provided such that pumps 136 can be selectively driven by motor 140. Further, motor 140 is optionally electronically controlled such that its rotational speed can be adjusted based on measurements obtained from a load sensor, thus permitting a constant predetermined rate of revolutions and therefore a constant flow rate to be provided.

One of the benefits realized in using one electrical motor supplying power to a series of inexpensive pumps is the reduction in cost of manufacture when compared to the gas pumps that are typically used and which generally cost more than $40.00 each. Some conventional systems have as many as ten or more such gas pumps. In addition to the foregoing, use of a series of inexpensive pumps, which are selectively powered from a common motor, also results in a savings of time and money because there is no longer a need provide and connect traditional $CO_2$ supply lines for the pumps.

Yet another benefit includes the ability to pump liquids having different viscosities such as sodas or liquids containing pulp such as juices, without making any mechanical adjustments or having to change the entire pump as is typically required with conventional syrup or juice pumps. Some peristaltic pumps, for example, are capable of pumping slurries containing up to 80% inorganic solids or sludge of 10% organic solids. Because of the ability of peristaltic pumps to pump a very wide range of viscosities, and even to be operated in a dry state without damage to the pump, the use of peristaltic pumps in the present invention provides particularly desirable results and can enable beverage manufacturers to supply and market syrups and/or beverage concentrates of super high concentration, thus enabling the present invention to save an even greater area of space without reducing its capabilities.

Yet another possible embodiment would consist of supplying compressed air in between the supply container and the supply bag to create a high pressure force on the bag that would propel the beverage to the dispensing nozzle 142. This method although economical to pump, could prove undesirable because of the difficulty of a processor to control and make self adjustments to the beverage being dispensed without the use of complicated peripheral devices.

Liquid holding containers 146, 148, and 150 are preferably used to store and prepare the different types of waters used in the mixing of the beverages. For example, container 146 can be used to store cold, noncarbonated water; container 148 can be used to store hot, noncarbonated water; and container 150 can be used to store cold carbonated water. Optionally, room temperature noncarbonated or carbonated water can be provided directly from the filtration device or carbonator 120 and need not necessarily be stored. As previously mentioned, container 146 can store cold non-carbonated water. Optionally, it can be stored in the freezer and can thus chill the water by exposing it to the low temperature in the freezer. A heating element and thermostat can optionally be provided to ensure that the water contained in container 146 does not freeze. Cold water from container 146 can thus be used for juices, teas, milk, or any noncarbonated beverage desired cold. The water for container 146 can be supplied directly from the filtration device through water supply line 152 and delivered to dispensing nozzle 142 through separate supply line 154. Container 148 can store hot water. It can heat the water to a desired temperature with a heating element and keep it constant with a thermostat. The hot water from container 148 can be used in coffees, cocoas, teas, or any other beverage that is desired to be served hot. The water for container 148 can also be supplied directly from the filtration device through water supply line 152 and delivered to nozzle 142 by line 156.

Container 150 is preferably used to store cold carbonated water in a manner similar to that of container 146. Although containers 146 and 148 can be configured in any known manner and can thus comprise containers having little structural integrity, because container 150 is preferably used to store carbonated water, it is thus preferably configured to be air tight and to have sufficient strength to withstand the vapor pressure of the $CO_2$ that escapes, evolves, or is otherwise liberated from the carbonated water. Cold carbonated water from container 150 is thus ideal for soft drinks, club sodas, or any other chilled carbonated beverage. The carbonated water for container 150 preferably comes from carbonator holding tank 126 via supply line 158 and is preferably transferred to nozzle 142 by line 160. Water from water filtration system 114 preferably also connects to dispensing nozzle 142 via supply line 152 and can be used for juices and other non-carbonated drinks that are preferred to be served at room temperature.

Because some consumers, such as those with sensitive teeth, may prefer non-chilled carbonated water, non-chilled carbonated water can optionally be supplied to nozzle 142 from carbonator holding tank 126 by water supply line 158.

Each of supply lines 154, 156, and 160 preferably has an electrically-activated solenoid which can be turned on and off by a signal sent from the processor. Because of the pressure typically provided by water supply 112, that pressure causes each of supply lines 154, 156, and 160 to be charged to a similar pressure. Thus, when a product is not being distributed by the dispenser of the present invention, the solenoids preferably prevent any water from flowing through any of supply lines 154, 156, and 160.

With a load sensor which monitors the motor 140, the pumping rate of pumps 136 can be electronically controlled by the processor such that a constant flow rate can be provided, regardless of the viscosity of the liquid passing through pumps 136. After concentrate is pumped through pump 136, it is preferably mixed with carbonated and/or non-carbonated water at or near nozzle 142. The above mentioned embodiment is only one of several possible variations of the discussed invention and is not to be misconstrued to limit the device in any way. Other such variations include but are not limited to a stand alone counter top unit where the dispensing nozzle and interface rest on top of a counter or shelf. A stand alone commercial unit with larger capacities which may be used for commercial applications such as bars, restaurants, and offices.

Figure 2:
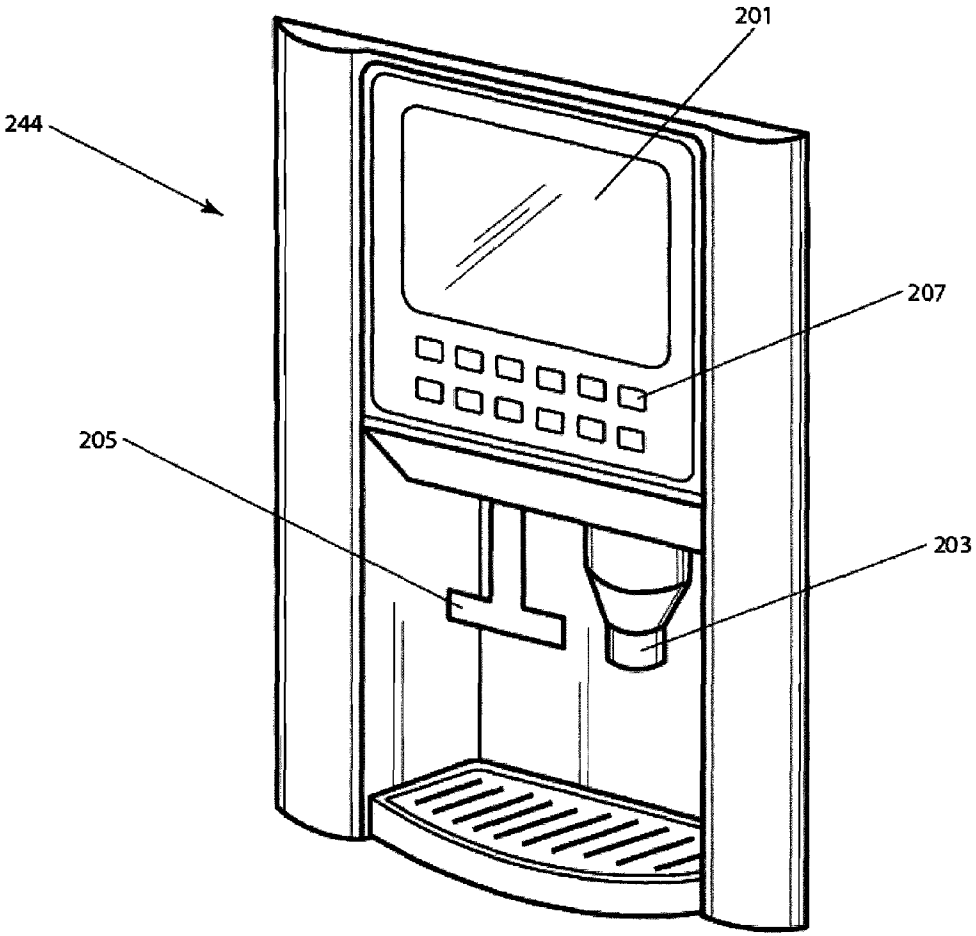
FIG. 2 is a drawing illustrating the dispenser interface of one embodiment of the present invention.

Referring now to FIG. 2, an actuator is illustrated according to one embodiment of the present invention. A dispenser interface 244, which can optionally have a processor as previously described and an assortment of quick dispense buttons 207 or user display 201 (preferably LCD touch screen) or any combination of the prior and/or an on key pad (not pictured). The processor preferably performs numerous functions relating to the delivery of syrup and/or concentrate and ratios thereof, as well as the activation of water types and delivery of alcohol whether mixed for shots or mixed for drinks. While the flow rate of the various waters used by the present invention can be monitored and adjusted by the processor; the flow rates are preferably predetermined and can optionally be regulated with a flow regulator.

In an embodiment of the present invention, product codes can optionally be inscribed on an exterior of the syrup/concentrate supply containers in plain sight. Along with the product codes, numbers representing preferred concentrate to water ratios, the type of water used, nutritional information, and/or the name of the beverage can optionally be encoded. In one embodiment of the present invention, these numbers can be input into the processor and the apparatus of the present invention can thus automatically adjust the concentration ration which the concentrate is mixed at. The name of the beverage and various information relating to the beverage, including but not limited to nutritional information, can thus optionally be displayed on the display when desired, as well as when dispensing a beverage. These codes can also enable the processor to prompt a user to select between hot or cold water when making a beverage such as tea. The encoded information stored on the syrup/concentrate supply containers can be input into the processor of the prevent invention through various manners known to those skilled in the art, including, keying the information in by hand, scanning an optical input device across the encoded information, and providing a magnetic storage medium with the encoded information stored thereon, wherein a user causes the magnetic storage medium to be read by a magnetic reading device.

In another embodiment of the present invention, the processor is preferably able to detect the quantity of concentrate remaining, and can thus warn a user when a concentrate needs to be replenished. Optionally, the monitoring may be targeted by user, such that a person who is charged with upkeep of the system is the first and/or only person notified of the need to refill a concentrate or perform maintenance.

In yet another embodiment of the present invention, users can be assigned unique user codes which can be entered before accessing features of the present invention. Additionally, users can selectively be assigned administrative privileges. As such, the parents of a household can be assigned administrative privileges and can thus set limits on the times, types, and quantities of beverages which the present invention will dispense to particular users. For example, a parent may allow a child to receive only twelve (12) ounces of soda beverage between 12:00 PM and 7:00 P.M. Monday through Friday, and twenty four (24) ounces of soda beverage between 10:00 AM and 8:00 PM on weekends. In addition, the parent may optionally allow the child to be dispensed twenty (20) ounces of juice beverage Monday through Friday from 7:00 AM to 8:00 PM. Further, the parent may allow the child to be dispensed any quantity of cold water at any time. Optionally, the parent can also review everything that was dispensed to each user, and the time of each day when dispersal was made to a user.

Users who are on diets, or diabetic, or otherwise interested in monitoring the nutritional information relating to the user's intake, can optionally observe a summary of all nutritional information which can be compiled and arranged to a user's specific desire.

In another embodiment of the present invention, a port, card slot, UPC reader or another input and/or output device can be provided such that a user can upload, download, and otherwise maintain an up-to-date database of beverage information which may be used in conjunction with software in computers to evaluate the information. Actuator buttons 207 can optionally be customizable with inserts provided on the exterior of syrup/concentrate supply containers as to show the branding of the product being dispensed. When pressed, actuator buttons 207 preferably initiate the dispensing of the desired beverage. An LCD touch screen 201 is preferably useful in the keying of the product codes into the processor, and can also be used to enter user identification and/or pin numbers.

Display screen 201 can be any type readily available in today's market (including but not limited to LCD, Digital, Analog, etc). If used, screen 201 preferably translates information into a readable form that the user can use and understand in order to more easily operate the present invention. The display preferably displays information pertinent to operations as well as any scheduled or needed maintenance.

The ice dispenser is preferably similar to those known in the art. The ice dispenser preferably comprises an activation member 205, such as a push-lever, for the dispensing of the ice and an apparatus for the making of ice similar to other known ice makers. Preferably, a majority of the operating components of the present invention are stored in a remote location such as inside a cabinet underneath a countertop, over the refrigerator, or in a closet or pantry.

Dispensing nozzle 203 preferably functions as the blending area for the concentrate and the different types of waters. All concentrates are preferably connected through a series of small tubing 172 (see FIG. 1) to nozzle 203, and all of the water types are preferably connected through a relatively larger set of tubing 154, 156, and 160 (see FIG. 1), which likewise connects to nozzle 203. As such, nozzle 203, when two types of liquids are simultaneously dispensed, then creates a whirlwind effect as to properly mix the two liquids together and form one beverage consistent in color and taste thus providing the consumer with an environmentally friendly, convenient, and economical beverage.

Figure 3:
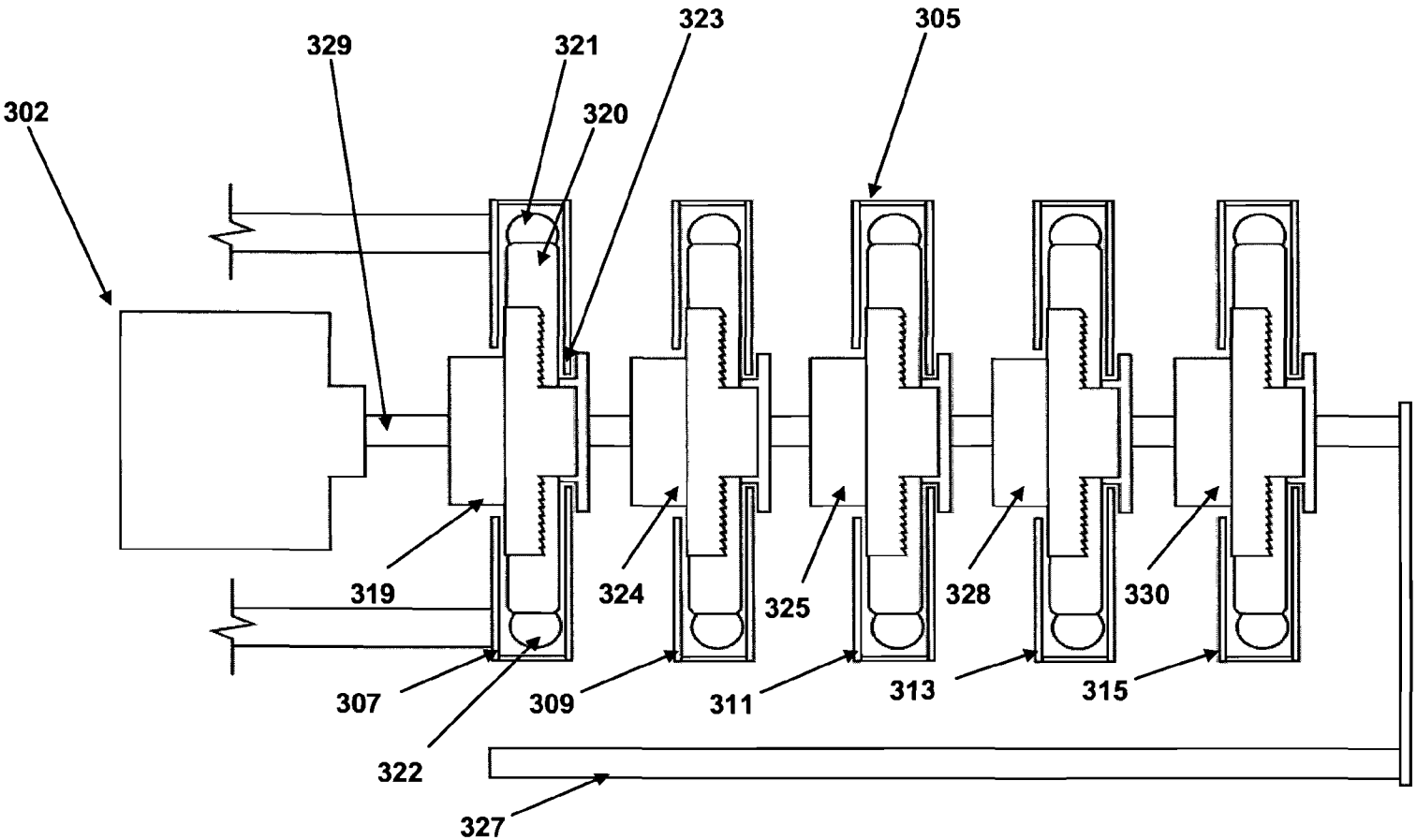
FIG. 3 illustrates multiple pumps driven by a single motor with unique clutch mechanism according to one embodiment of the present invention.

Referring now to FIG. 3 a cross section of a peristaltic pump and motor assembly is illustrated according to one embodiment of the present invention. A motor 302 drives a shaft 329 about which are one or more clutch plates 319. One or more peristaltic pumps 307, 309, 311, 313, 315 are associated with the shaft 329. A tubing press 320 about which tubing rests (not shown) rotates when engaged by a clutch 319. The tubing is snuggly positioned between the tubing press and the wall of the peristaltic pump housing. The tubing enters the first pump through a tubing inlet 322 and exits the peristaltic pump 307 through a tubing outlet 321. The rotation of the tubing press causes liquid in the tubing to move through the tubing via peristaltic action. FIG. 3 indicates clutch plate 319, 324, 325, 328, 330 on pumps 307, 309, 311, 313, 315 are engaged. However, because each pump may be independently activated, fewer than all of the pumps on a shaft driven by a motor may be engaged. For example, pump 311 and 315 may be engaged while pump 307, 309, and 313 may be un-engaged or alternatively, only pump 309 is engaged. Clutch plate 319, 324, 325, 328, 330 moves in the direction of the arrow. When the clutch plate is displaced toward the tubing press to a sufficient distance, the clutch plate engages the tubing press and the tubing press rotates within the pump housing.

Figure 4:
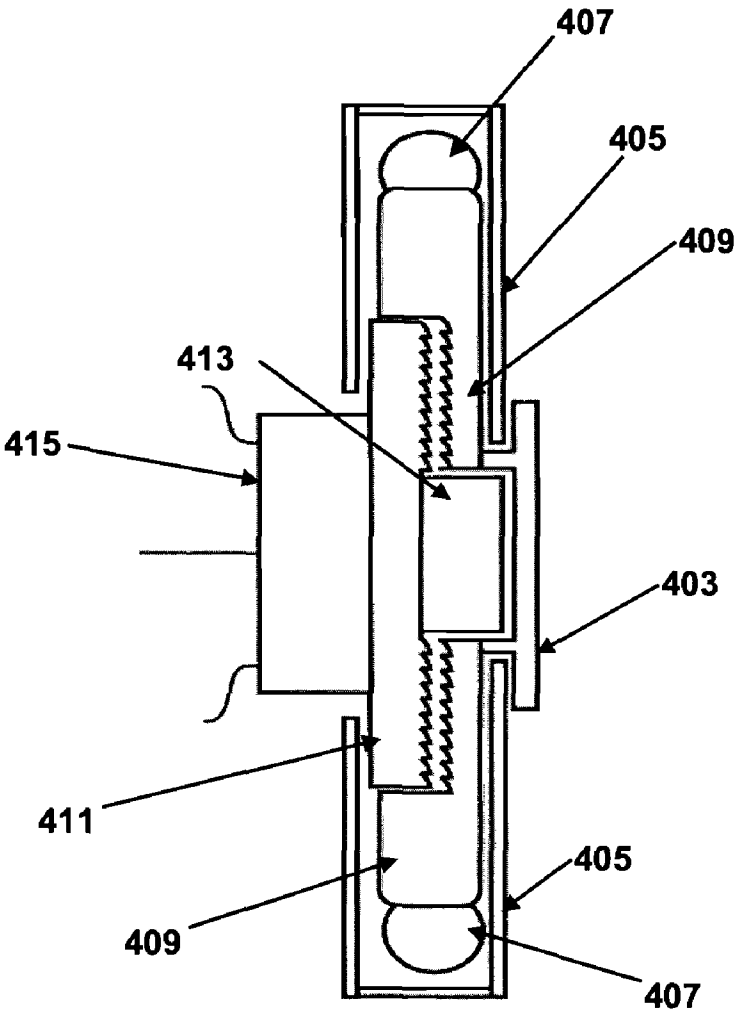
FIG. 4 is a clutch mechanism for a pump according to one embodiment of the present invention illustrates a FIG. 5 illustrates an exploded view of a peristaltic pump according to one embodiment of the present invention.

Referring now to FIG. 4, a cross sectional view of a peristaltic pump is illustrated according to one embodiment of the present invention. Electromagnetic clutch face 411 is engaged with the tubing press 409 when electromagnet 415 is magnetized or demagnetized and the electromagnetic clutch face 411 is displaced toward the tubing press as guided by the electromagnetic clutch guide 413. Electromagnetic clutch guide 413 guides the clutch to engage the tubing press 409. Tubing (not shown) enters and exits the pump housing 405 through tubing ports 407. Tubing press stabilizer 403 keeps tubing press 409 centered and in place when not in use.

Figure 5:
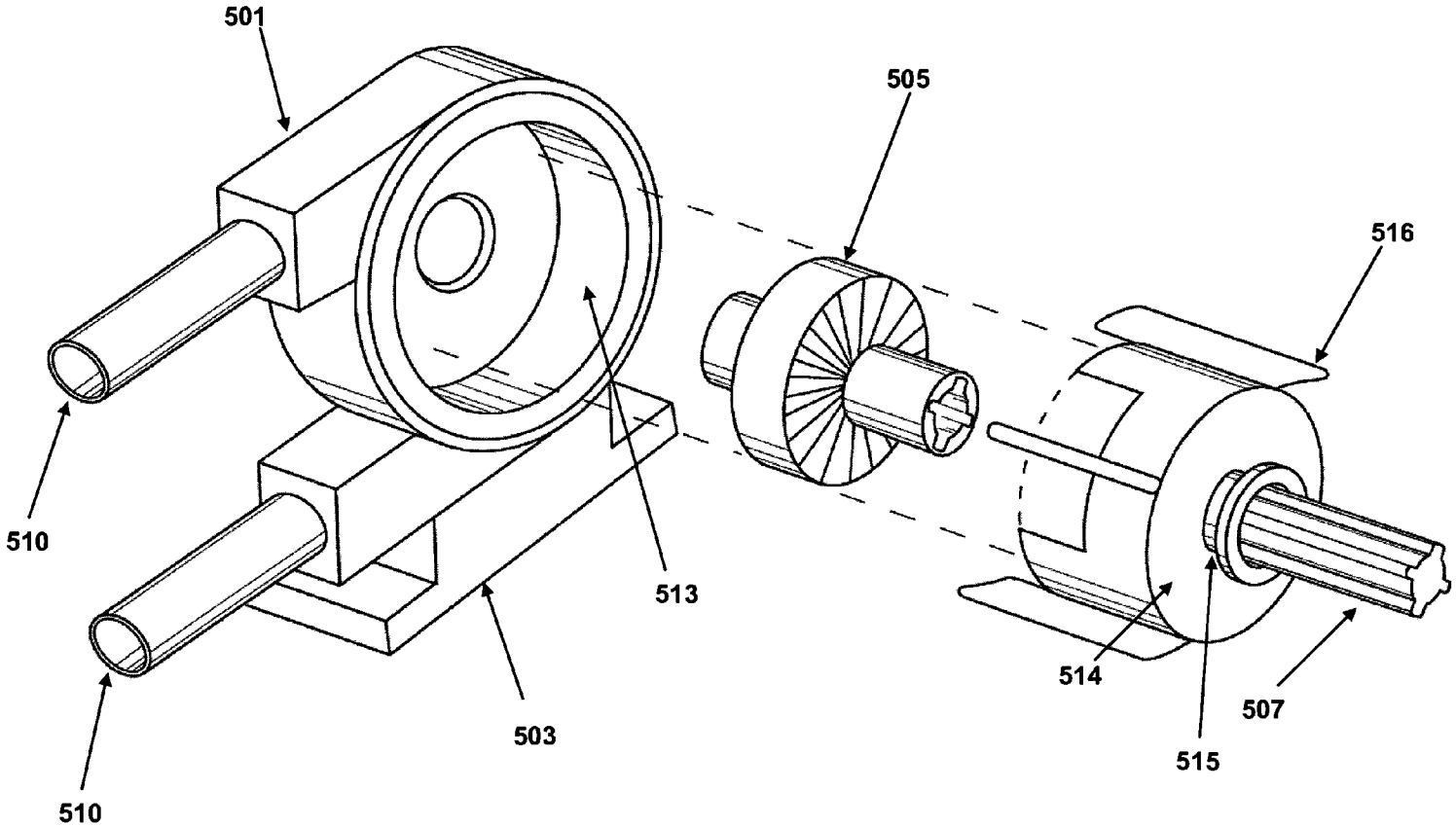

Referring now to FIG. 5 an exploded view of a pump according to one embodiment of the present invention is illustrated. A pump housing 501 houses an electromagnetic clutch 505 associated with the shaft 507. Clutch 505 engages the tubing press 514 and causes the means for pressing the tubing 516 for example lobes, fins or rollers located about the tubing press 514 to press against the tubing as the tubing press 514 rotates. The tubing 510 enters the press. The tubing within the pump is positioned between the tubing press 514 and the press wall 513. Tubing press stabilizer 515 acts as a guide to the tubing press 514 in position while disengaged. However, the peristaltic pum does not require the tubing to be pressed against a wall as distortion of tubing stretched about an object wherein a means for pressing the tubing such as a roller, lobe, fin or combination thereof could be applied to the stretched tubing which would not require the tubing to be pressed against a wall of the pump housing.

Figure 6:
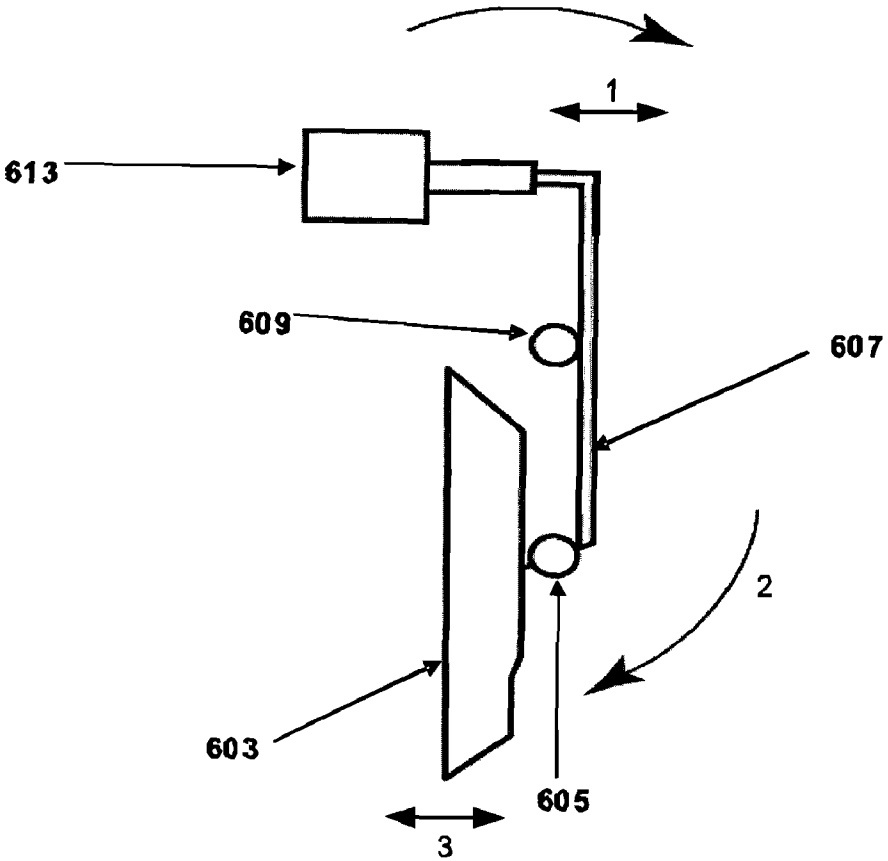
FIG. 6. illustrates a view of a peristaltic pump clutch according to one embodiment of the present invention.

Referring now to FIG. 6 another embodiment of a clutch to activate pump is illustrated according to one embodiment of the present invention. The clutch face 603 is displaced in the direction as indicated by arrow 3 when the actuator arm 607 is displaced in the direction indicated by arrow 2 as the actuator 613 is displaced in the direction of arrow 1. Shaft (not shown) is positioned in the middle and through clutch face 603. Clutch face 603 rotates as the shaft rotates. Swivel 605 acts to keep the clutch face parallel to the tubing press (not shown). Pivot point 609 acts as central point upon which to rock the actuator arm.

Figure 7:
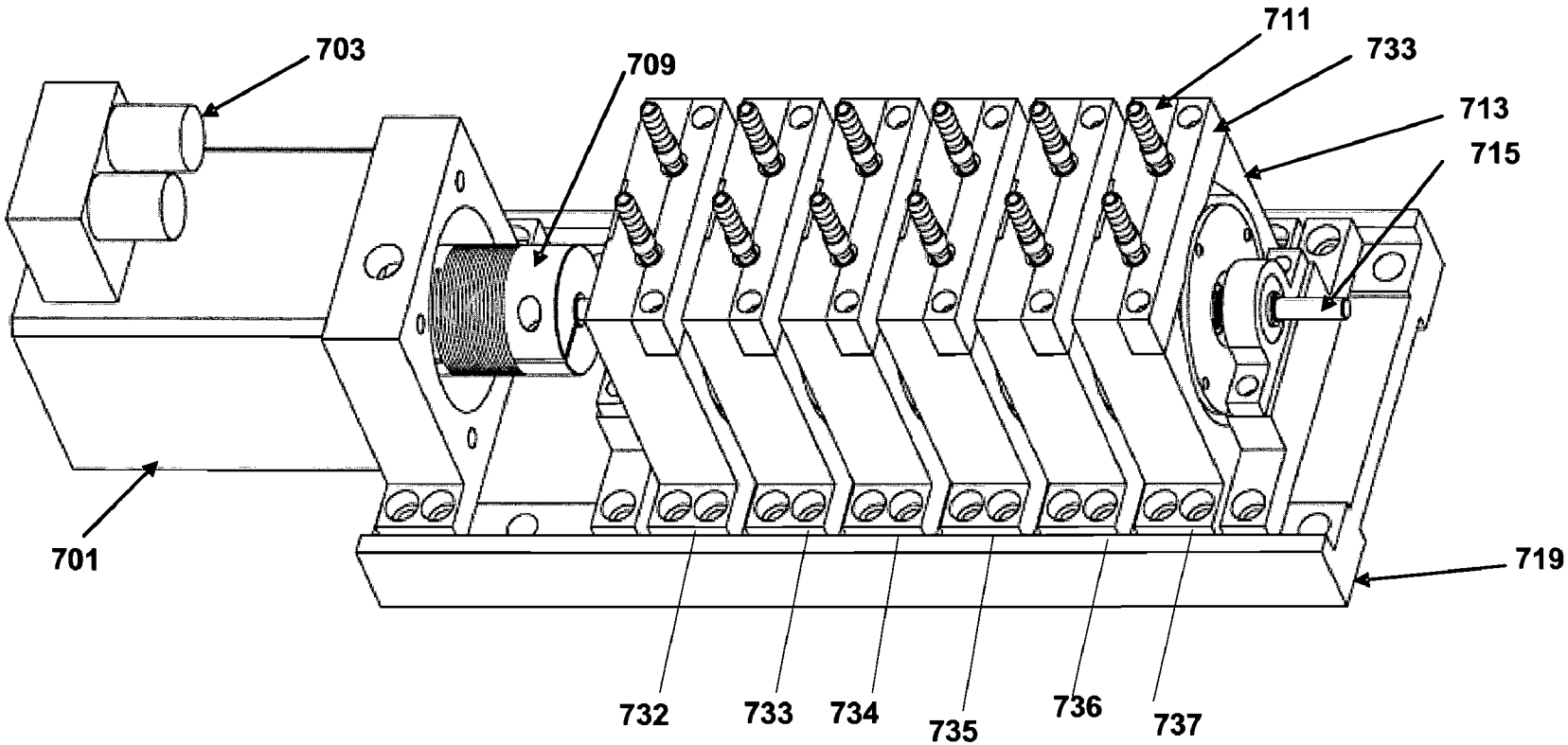
FIG. 7 illustrates a perspective view of a series of peristaltic pumps driven b a motor according to one embodiment of the present invention.

Referring now to FIG. 7 a perspective view of a series of peristaltic pumps on a motor is illustrated according to one embodiment of the present invention. Motor 701 which may be AC or DC rotates a shaft 715. Pump 732, 733, 734, 735, 736 and 737 are engaged independently of each other by a clutch associated with each unique tubing press for each peristaltic pump. For example the amount of fluid delivered by pump 732 may be half that required as compared to pump 733 therefore the clutch would only engage pump 732 for half the time as compared to pump 733 if the amount of fluid delivered to a dispenser by pump 732 would otherwise be the same amount as delivered by pump 733. In addition amount of fluid delivered to a dispenser can also be altered by changing the diameter of the tubing that is associated with each peristaltic pump and or the diameter of each tubing press and peristaltic pump housing. Each pump may be selectively activated by a motor to which it is in communication and or associated. Each of pumps 732, 733, 734, 735, 736 and 737 is attached to a concentrate supply source (not shown) via tubing from which a fluid is pumped. The supply source can be the same or different between one or more pumps.

Figure 8:
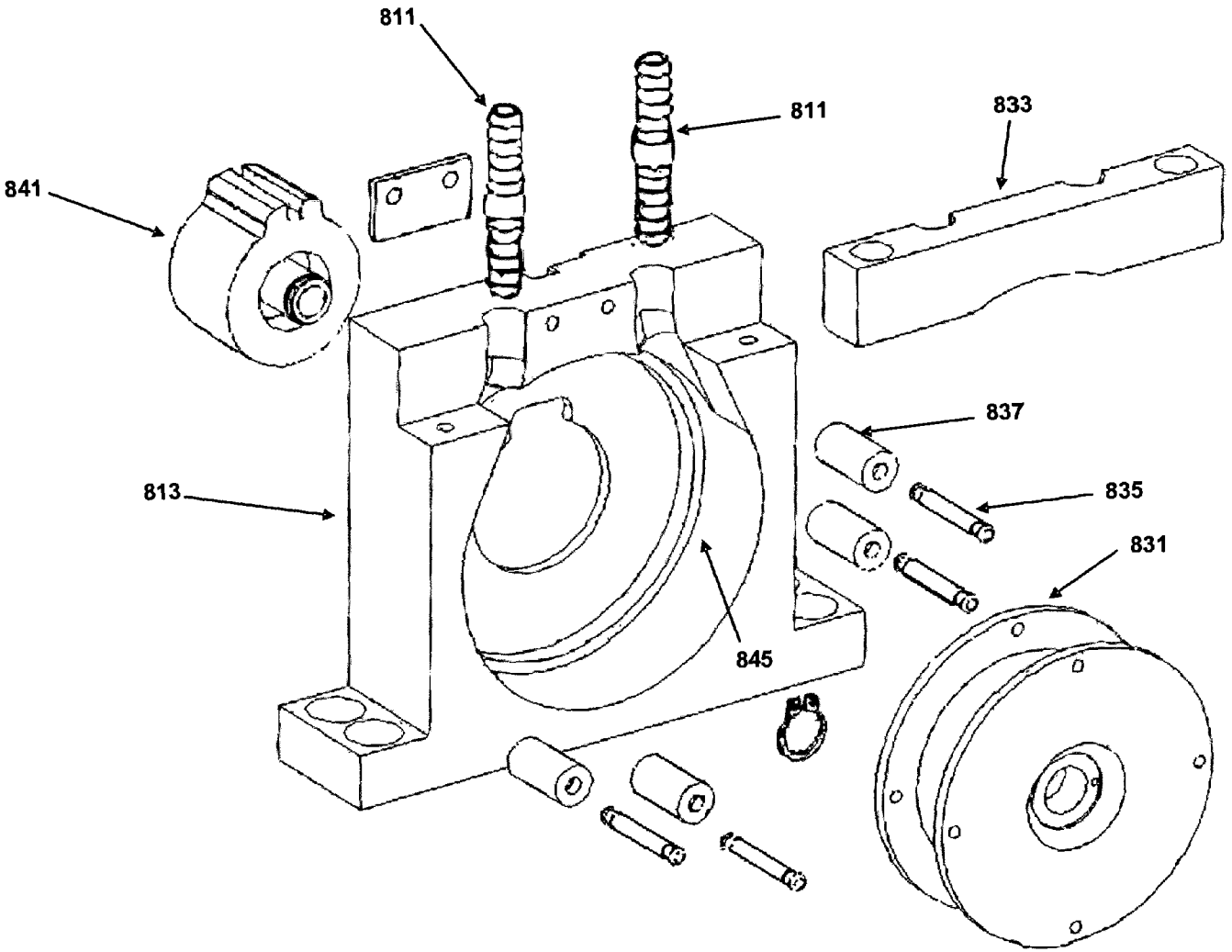
FIG. 8 illustrates an exploded view of a peristaltic pump according to one embodiment of the present invention.

Referring now to FIG. 8 an exploded view of a peristaltic pump according to one embodiment of the present invention is illustrated. Electromagnetic spring wrap clutch 841 engages roller press bracket 831. The tubing (not shown) rests upon rollers 837 connected or associated with the press bracket 831 via pin 835. Tubing is pressed against the wall 845 of the pump inside pump housing 813 and forces liquid to move through the tubing (not shown). Tubing ports 811 guide the tubing from the supply source to the deliver point or dispenser. Tubing pillow block pad 833 holds tubing in place. Roller 837 is held in place by roller pin 835 and operates as an axle to the rollers.

Figure 9:
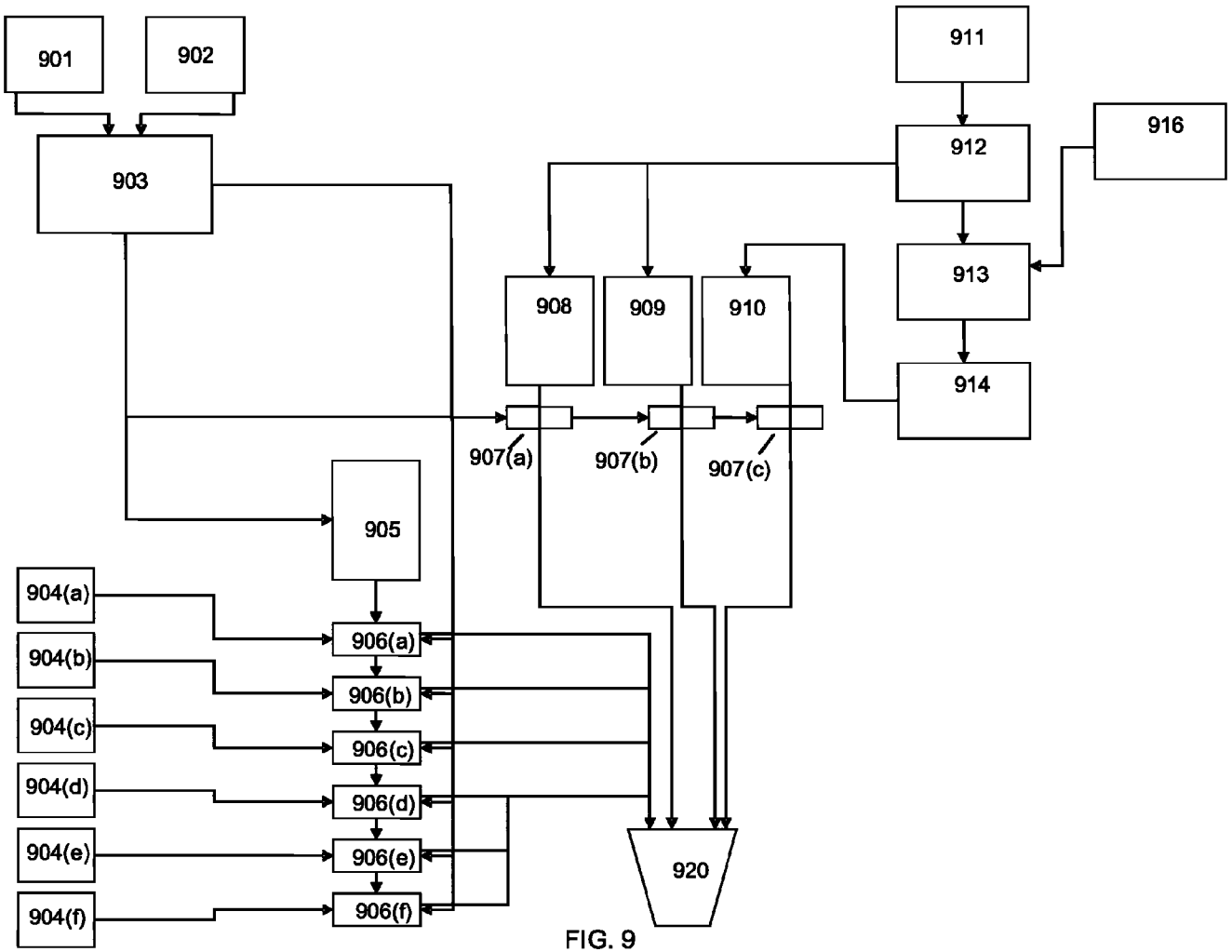
FIG. 9 illustrates a flow diagram of one embodiment of the present invention.

Referring now to FIG. 9 a flow chart of the system is illustrated according to one embodiment of the present invention. LCD panel control 901 and instant dispense buttons 902 are in communication with a processing unit 903. Processing unit 903 transmit instructions to one or more pumps 906 *a-f*, pump motor 905 and one or more valves 907 *a-c*. One or more pumps 906 *a-f* are in fluid communication with a supply source 904 *a-f*. The selection of a beverage by a user will control whether a cold water storage tank, a hot water storage tank, a carbonated storage tank, a combination thereof or no storage tank sends fluid through one or more of valves 907*a-c* to a dispensing nozzle 920. water supply 911 provides water to one or more of storage tanks 908-910. The water may pass through water conditioning unit 912. $CO_2$ supply 916 delivers $CO_2$ to storage tank 910 via agitating pump 913 and holding tank 914 which is activated by pump 2.

Further, providing a more concentrated beverage concentrate enables the present invention to operate with an even greater reduction in waste, thus further benefiting the environment.

One of the benefits of using peristaltic pumps is that the concentrate being pumped never touches any mechanical parts. This reduces the chance of cross contamination of flavors and lessens the chance of bacterial growth, thus making the device easier to clean.

Yet another added benefit of using peristaltic pumps is the ability to measure the quantity and rate of fluid pumped with great accuracy. This is due to the consistent volume flow which is directly related to the number and speed of the revolutions of the peristaltic pump.

Other issues with typical gas pumps are that when changing from colas to juices or vice versa, typical gas pumps usually require that a trained technician change the pump. Even simply changing between brands may require making adjustments to the nozzle as to adjust the water to syrup ratio for that particular product. The reason for such adjustments is because of the inability for a typical gas pump to make self adjustments.

Another drawback to conventional gas pumps is the expulsion of gases into the atmosphere which can, in confined spaces, cause loss of consciousness or death. To ensure that there are no gases expelled into a room or confined space, typical gas pumps often have an exhaust port which the manufacturer recommends be routed to the exterior of a building, thus necessitating the drilling of a hole in an exterior wall.

Yet another drawback to the conventional gas pumps is that such pumps drain the $CO_2$ supply more quickly, thus resulting in increased costs and the need to frequent the supply store more often for refills.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above and/or in the attachments, and of the corresponding application(s), are hereby incorporated by reference.

What is claimed is:

1. A beverage dispenser comprising:

a plurality of concentrate supply sources, each individual concentrate supply source in fluid communication with an individual peristaltic pump, and each concentrate supply source and pump pair being in individual fluid communication with a singular beverage dispensing nozzle;

one or more a variable speed motors, each said motor directly powering a single shaft, said single shaft being individually mechanically linked to a each of a plurality of clutches, each individual said clutch being capable of activating the operation of an individual peristaltic pump by transferring power from said single shaft to said individual peristaltic pump;

means for selectively and independently controlling the activating of one or more of said clutches;

one or more water supply lines that are connected to said beverage dispensing nozzle;

a carbonation source connected to said beverage dispensing nozzle; and said beverage dispensing nozzle comprising a blending area.

2. The beverage dispenser of claim 1 wherein;

the clutches used are of the electromagnetic wrap spring type.

3. The beverage dispenser of claim 1 wherein the clutches used are of the mechanical swivel and pivot point type.

4. The beverage dispenser of claim 1 wherein said water supply lines are selected from a carbonated water supply line, hot water supply line, a cold water supply line or a combination thereof.

5. The beverage dispenser of claim 1 wherein said water supply lines comprise a cold water supply line.

6. The beverage dispenser of claim 1 wherein said means for selectively activating one or more said clutches being capable of activating the operation of said individual pumps are controlled by a processing unit.

7. The beverage dispenser of claim 1 wherein said one or more motor are individually controlled by a processing unit.

8. The beverage dispenser of claim 6 wherein said processing unit is controlled by a user interface.

9. The beverage dispenser of claim 7 wherein said processing unit is controlled by a user interface.

10. The beverage dispenser claim 7 wherein said processing unit regulates speed and duration of the motor.

11. The beverage dispenser of claim 1 wherein there are three or more individual peristaltic pumps per said motor.

12. A beverage dispenser comprising:

a plurality of peristaltic pumps, each said pump individually coupled to a clutch, each said clutch powered from a single shaft connected mechanically coupled to one or more drive motor;

a concentrate supply source in fluid communication with a beverage dispensing nozzle; and one or more water supply lines in fluid communication with said beverage dispensing nozzle.

13. The beverage dispenser of claim 12 further comprising a user interface.

14. The beverage dispenser of claim 13 wherein said user interface comprises a display.

15. The beverage dispenser of claim 12 wherein said dispenser further comprises a processor programmed to distinguish one or more users based on a user code.

16. The beverage dispenser of claim 13 wherein said dispenser can be programmed to function differently as determined by the inputting of a unique user code into the user interface.

17. The beverage dispenser of claim 14 wherein product information can be displayed on the display.

18. The beverage dispenser of claim 17 wherein the product information comprises nutritional information for the product.

19. A method for dispensing a beverage comprising:

assigning one or more user codes to a processor of a beverage dispenser;

providing to the processor at a user interface dispensing rules associated with the one or more users;

requesting a beverage to be dispensed;

allowing or denying by the processor the dispensing of a beverage to the one or more users based on the processor dispensing rules, which will vary the flowing rate of each component of the mixed beverage dispensed; and dispensing a thoroughly mixed beverage from the beverage dispenser to the one or more users when the processor dispensing rules allows the processor to activate a motor which powers the shaft connected to a plurality of one or more clutches, and activates one or more said clutches for a period of time, thereby activating one or more pump within the beverage dispenser to dispense a thoroughly mixed beverage to the user when the request is authorized by the dispensing rules.

20. The method of claim 19 further comprising assigning one or more administrative codes to one or more users.

21. The method of claim 19 further comprising displaying product information to a display in conjunction with the dispensing of a beverage.

22. The method of claim 19 further comprising entering product data into a processor.

23. The method of claim 19 wherein the product data is encoded and provided with a concentrate.

24. The method of claim 23 further comprising automatically populating a display of the beverage dispenser with product data information received from concentrates installed.

25. The method of claim 23 wherein the entering of product data is performed by electronically scanning the data into the processor.

* * * * *